US006679438B1

(12) United States Patent
Didlo

(10) Patent No.: US 6,679,438 B1
(45) Date of Patent: Jan. 20, 2004

(54) GUARD FOR SPRAY APPLICATOR

(76) Inventor: Todd Didlo, 1531 W. 17th St., Tempe, AZ (US) 85281

( * ) Notice: Subject to any disclaimer, the term of this patent is extended or adjusted under 35 U.S.C. 154(b) by 0 days.

(21) Appl. No.: 10/353,133

(22) Filed: Jan. 27, 2003

Related U.S. Application Data

(60) Provisional application No. 60/364,856, filed on Mar. 13, 2002.

(51) Int. Cl.[7] ..... B05B 1/28; B05B 15/04; B05B 1/26; B05B 1/34

(52) U.S. Cl. ..... 239/288.5; 239/461; 239/505; 239/499

(58) Field of Search ..... 239/288.5, 461, 239/288.3, 288, 505, 499, 103, 150, 518, 600, 271; 111/7.1–7.4; 285/148.23, 148.18, 148.22, 334.2, 334.5, 139.1, 139.3

(56) References Cited

U.S. PATENT DOCUMENTS 2,928,610 A * 3/1960 Fenimore ..... 239/288.5
3,092,334 A * 6/1963 Peterson ..... 239/516
3,672,380 A * 6/1972 Schuster ..... 134/172
3,770,204 A * 11/1973 Schuster ..... 239/288.5
4,541,568 A * 9/1985 Lichfield ..... 239/441
4,620,669 A * 11/1986 Polk ..... 239/120
4,865,257 A * 9/1989 Bailey ..... 239/288.5
5,170,943 A * 12/1992 Artzberger ..... 239/532
5,671,586 A * 9/1997 Weder ..... 53/397
5,794,855 A * 8/1998 Ledford ..... 239/288
5,975,432 A * 11/1999 Han ..... 239/526
6,145,756 A * 11/2000 Kohls ..... 239/288
6,209,807 B1 * 4/2001 Hsin-Fa ..... 239/600

* cited by examiner

*Primary Examiner*—Michael Mar
*Assistant Examiner*—Darren Gorman
(74) *Attorney, Agent, or Firm*—Gregory J. Nelson

(57) ABSTRACT

A spray guard that may be used with a spray applicator of the type used to apply agriculture and garden chemicals. The guard has an adaptor with a conical body and a flared skirt. The conical body is slotted to accommodate insertion over the spray wand of the sprayer. A clear, conically-shaped spray shield is securable to the adaptor. The shield is preferably provided to the user in a flattened condition and assembled into conical shape by the user. The spray shield may be trimmed to size by the user and may be easily replaced by removing it from the adaptor.

6 Claims, 3 Drawing Sheets

GUARD FOR SPRAY APPLICATOR

CROSS REFERENCE TO RELATED APPLICATION

This application is based on provisional application S. No. 60/364,856, filed Mar. 13, 2002, of the same title.

FIELD OF THE INVENTION

The present invention relates to a guard for a spray applicator and more particularly relates to a guard attachable at the end of the wand of a spray applicator of the type commonly used by gardeners. The guard will confine the spray to prevent the spray from being applied to adjacent surfaces and plants.

BACKGROUND OF THE INVENTION

It is customary for gardeners, both professional and amateur, to apply various types of fertilizers, insecticides, pesticides and herbicides by spray applicators. Typically these spray applicators include a tank which contains the liquid to be sprayed. Often liquid is provided in concentrated form and is mixed with water and then poured into the tank. The tank may be of varying capacity from a gallon or two to one having a much larger volume. The contents of the tank may be pressurized either manually by a hand pump and in some cases may be pressurized using an air source such as an air compressor. A flexible hose is attached to the tank and is then connected to a feed tube which depends within the tank. A tubular wand at the end of the flexible hose is attached to a spray nozzle which is often adjustable to regulate the spray from a fan-shaped spray to a more concentrated stream. A valve having a lever is manually operable to control the flow from the nozzle.

When utilizing sprayers of this type, it is often desired to apply the spray only to a specific plant or area. However, because of wind conditions, or improper use of the spray device due to inattentiveness or carelessness, the spray may be applied to or drift onto adjacent plants or soil surfaces. This may be a particularly serious problem, especially when chemicals such as herbicides are being applied as the spray drifting to adjacent vegetation or over spraying may actually harm or kill adjacent vegetation. Therefore, even if the users of such equipment are extremely careful, unintended harm can result when spraying, particularly when using lawn, garden and agricultural chemicals. A further problem is that the spray that is discharged or released may be toxic and may be harmful to the individual using the device.

Therefore, in view of the foregoing, there exists a need for a type of device to direct and confine sprayed chemicals to a particular area and to prevent them from being released or discharged onto adjacent soil, vegetation or into the air where they may be harmful to individuals.

U.S. Pat. No. 4,865,257 discloses a spray guard adapted for use with a lawn for spraying liquid onto vegetation. The wand has a cylindrical shaped discharge tube and a nozzle tip attached to the end of the discharge tube. The spray guard includes a dome having an open end provided with an aperture through which the discharge tube may selectively extend. The dome channels, directs and focuses spray emitted from the nozzle toward a relatively localized area.

While devices of the type as shown in the '257 patent to some extent help to direct a localized spray and prevent an unintended release of the application of spray, they are not widely used as often because of inconvenience and unadaptability to a wide range of sprayers.

Accordingly, a need exists for a simple, inexpensive and effective guard for use in connection with sprayers of this type.

BRIEF SUMMARY OF THE INVENTION

Briefly, the present invention provides a spray guard for use with a sprayer wand having a nozzle discharge. The spray guard of the present invention has an adaptor with a generally cylindrical body which defines a slot to allow the adaptor to be flexed sufficiently to be placed over the spray wand above the discharge nozzle and held in frictional engagement with the wand. The lower end of the adaptor is formed as a cylindrical skirt having securement means which in a preferred embodiment is an adhesive section with a peelable or removable strip covering around its lower edge. One or more panels are provided to the user in a flat or planar condition. The panels are generally semi-circular and made of a transparent, flexible material. The panels are assembled into a conical shape by engaging male and female fastener sections that are integrally formed along the diametral edge of the semi-circular panel. When assembled into a cone, the cone can then be attached to the adaptor at the securement means as by removing the peelable strip covering the adhesive on the lower edge of the adaptor and inserting the adaptor into the cone so the body of the adaptor extends from the upper end of the cone. The cone may be provided with trim lines along its lower edge so that it may be cut to a various sizes by the user. The device can easily be removably attached to the lower end of the sprayer applicator wand above the nozzle to control and confine the area to which the spray is applied. In an alternate embodiment, mechanical fasteners may be used to detachably secure the adaptor to the shield.

BRIEF DESCRIPTION OF THE DRAWINGS

The above and other objects and advantages of the present invention will become more apparent from the following description, claims and drawings in which:

DETAILED DESCRIPTION OF THE DRAWINGS

Figure 1:
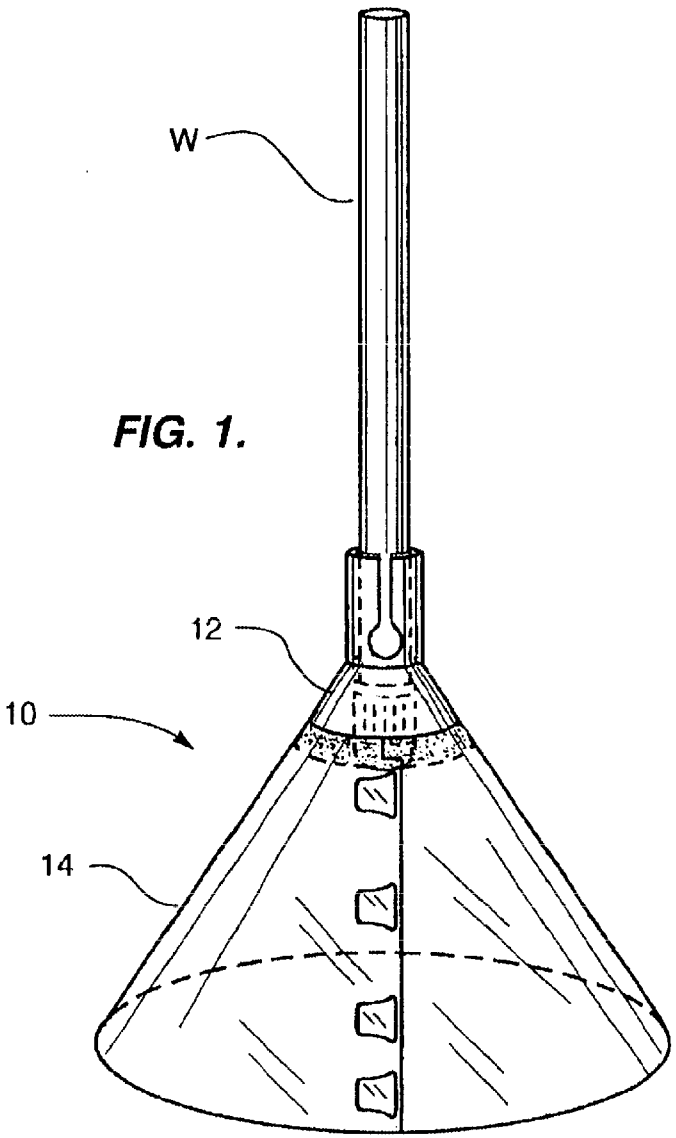
FIG. 1 is a perspective view showing the spray guard of the present invention attached to the end of a conventional sprayer of the garden sprayer type.

Turning now to the drawings, the spray guard of the present invention may be used with sprayers of the type having a tank which contains the liquid to be applied. The liquid is applied under pressure through a flexible hose which terminates at a wand. The end of the wand carries a nozzle which may be adjustable from a fan spray to a more concentrated spray. Generally, a hand-operated valve having a lever is positioned at the upper end of the wand to allow the user to manually control the spray. These type of tank sprayers are well known to those skilled in the art.

As discussed above, a problem occurs when plants and vegetation are sprayed as the spray may be released into the air and drift onto adjacent plants and vegetation harming them. Even if efforts are made to contain the spray by carefully adjusting the spray pattern, conditions such as wind or carelessness on the part of the user, may cause accidental application of spray to areas other than the intended spray target.

Accordingly, turning now to the drawings, the spray guard of the present invention is generally designated by the numeral 10 and is comprised of two peripheral or major components, the adaptor 12 and the conical shield 14.

The adaptor 12 may be a molded item from a suitable plastic as rigid nylon or other material which is resistant to most chemicals and weather conditions. The adaptor 12 consists of a generally cylindrical body 16 which defines a central opening 20. The lower end of the body is formed having an outwardly flared conical skirt 24. The overall dimensions of the adaptor may vary but generally the overall height of the adaptor will be several inches for most tank sprayer applications.

An axially extending slot 30 is provided in the body of the sidewall of the adaptor terminating at an enlarged circular opening 32 at its lower end forming a generally keyhole shape. The purpose of the slot is to provide flexibility so that the adaptor may be easily, frictionally engaged with the end of the spray device, such as on the wand above the nozzle. A straight slot will work, however the keyhole-shaped opening allows the body of the adaptor to easily flex to sufficiently accommodate insertion of the spray applicator wand into and through the central opening 20.

The conical skirt 24 at the lower end of the body has a circular lower edge 34. An adhesive band 38 is applied along the area adjacent the edge 34 and is preferably covered by a peelable, removable cover 39. The adhesive band 38 accommodates attachment of the shield as will be explained below.

Figure 5:
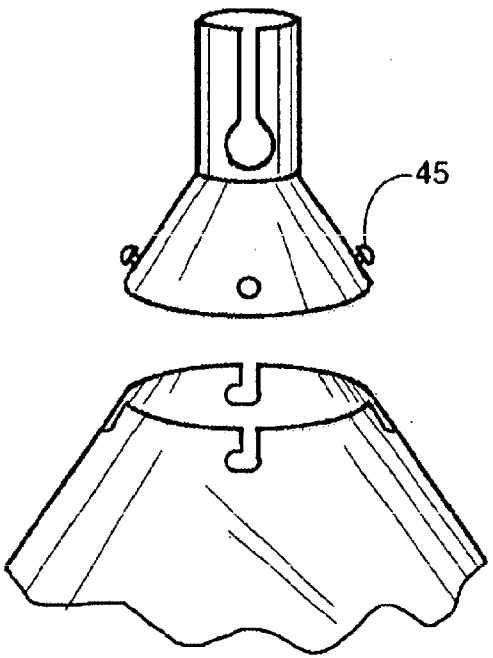
FIG. 5 is a partial perspective view showing an alternate means of detachably securing the shield to the adaptor.
Figure 2:
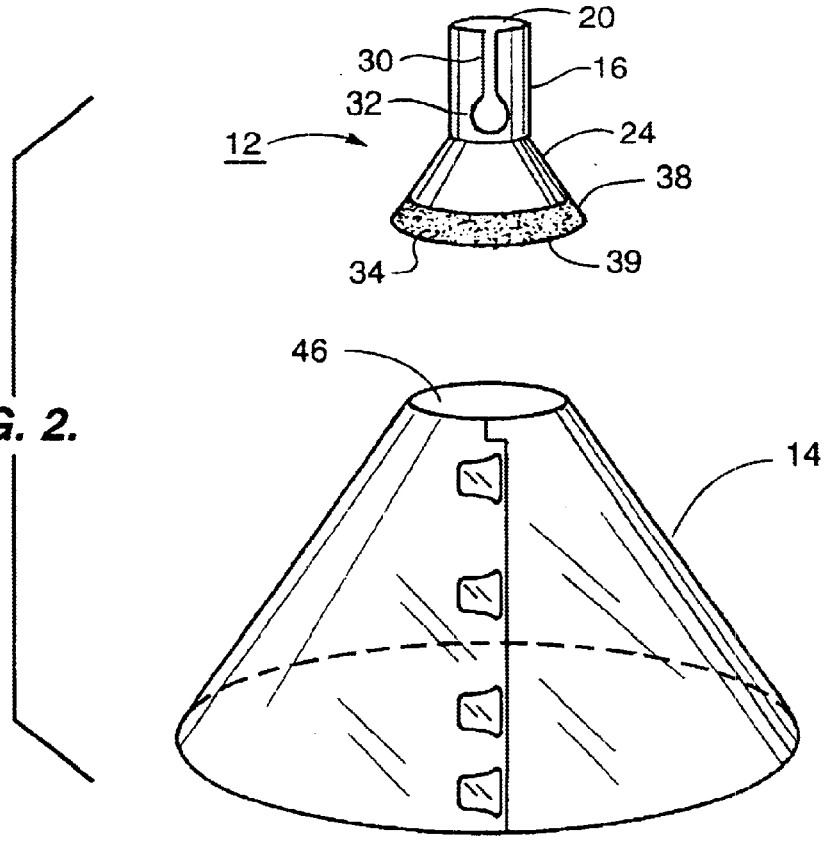
FIG. 2 is an exploded view showing the assembled shield and adaptor.
Figure 3:
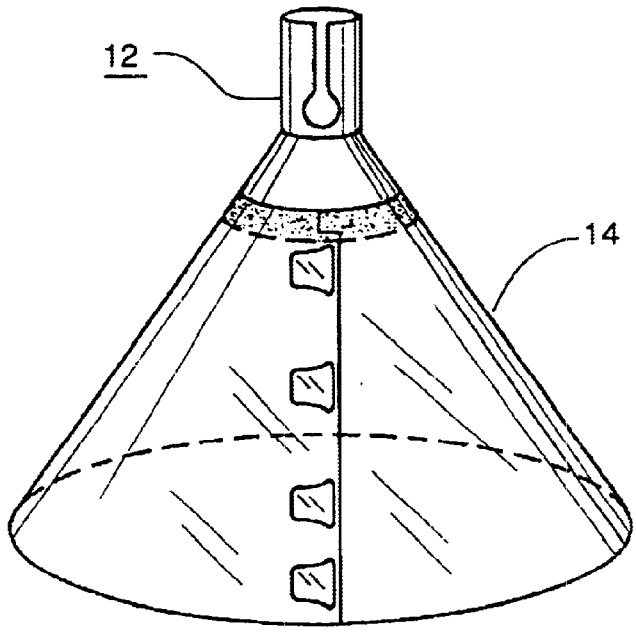
FIG. 3 is a view similar to FIG. 2 showing the adaptor attached to the upper end of the conical shield.

In some instances, the adhesive band may be eliminated and the shield held in place by frictional engagement between the shield and skirt or by mechanical fasteners such as projections 45 engageable in L-shaped slots 41 as seen in FIG. 5. It is preferred the shield be separate from the adaptor as the guard can be packaged and shipped in a compact condition.

Figure 4:
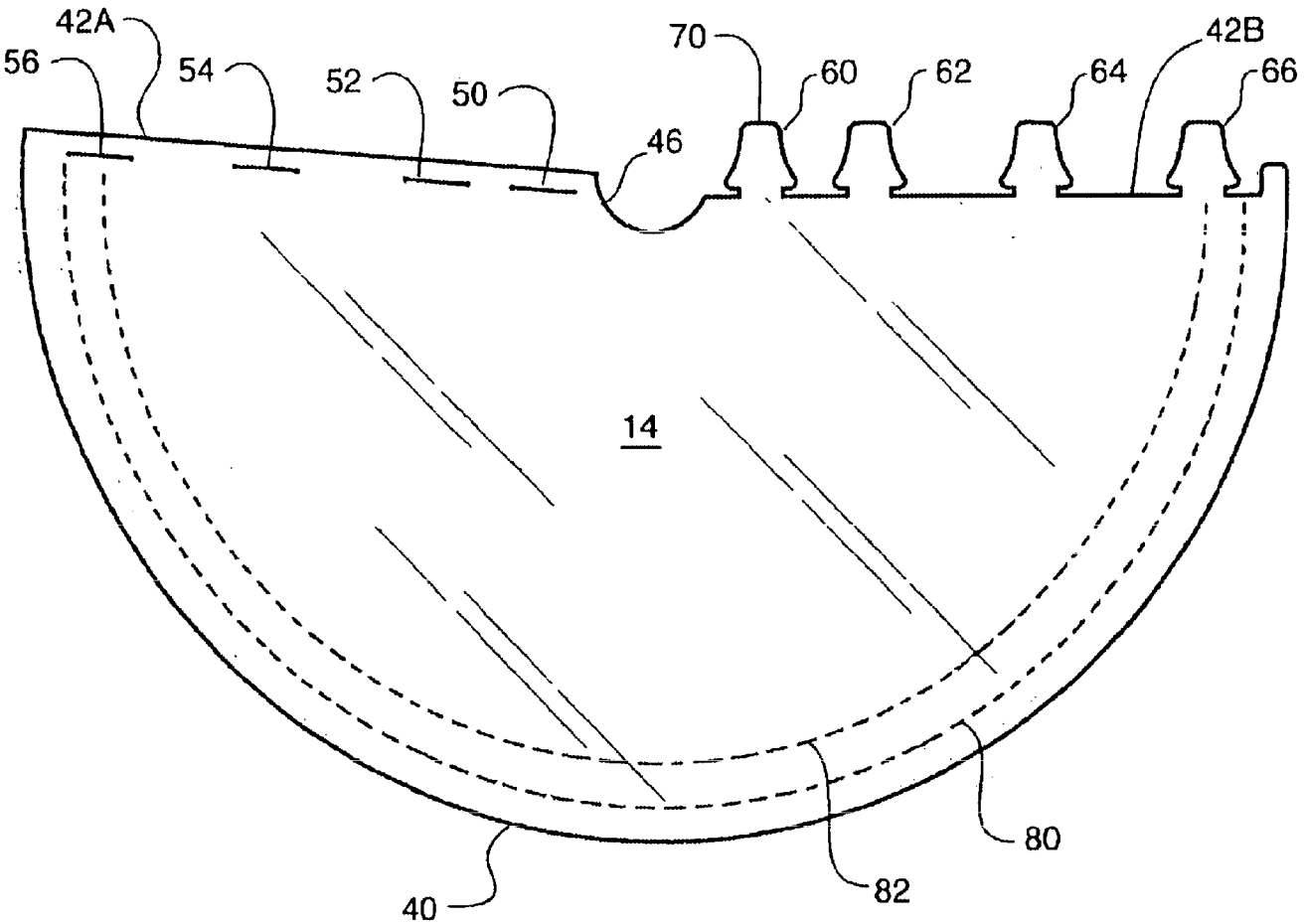
FIG. 4 is a plan view showing a conical shield in a planar condition as provided to the consumer prior to assembly.

Referring to FIG. 4, the shield 14 is shown as it is supplied to the user. For convenience and economy of the space, the shield will be provided in a flat, planar condition, as shown in FIG. 4. Further, since the shield may be manufactured in a flattened condition, fabrication is accommodated as the shield can be simply cut, as by die cutting from suitable material such as a 0.010" clear polyester material. A clear material is preferred so the user can view the area enclosed by the conical shield when applying a spray.

The shield, in the flat condition, has a generally semi-circular outer edge 40 and a generally axial diametral edge 42A, 42B. A semi-circular recess 46 is provided at the center of the shield along the diametral edges 42A, 42B. It will be seen that a plurality of slots 50, 52, 54 and 56 are provided along the diametral edge 42A. A plurality of tabs 60, 62, 64 and 66 project from the diametral edge along edge 42A. The tabs are positioned to be aligned with the slots when the shield is erected and shaped from a flattened condition into a conical condition. For example, tab 60 is securable in slot 50, tab 62 is securable in slot 52, etc. Each of the tabs is somewhat arrow-shaped having a flattened nose 70 and an undercut area 72 at the base so the tabs may be inserted into the slots and engaged into the slots to retain the shield in a conical condition. The shield is dimensioned so that the skirt of the adaptor may be received within the interior of the cone with the body 16 extending through an opening defined at 46. When the peelable covering 39 over the adhesive 38 is removed, the adhesive strip may be adhered to the inner surface of the shield adjacent the upper end of the shield.

As seen in FIG. 4, the guard may be provided with a plurality of trim lines 80, 82 extending along the lower edge 40. This will provide the user with guide lines in the event the user wishes to trim the overall height of the shield in accordance with the spray application.

In use, the shield 14 is erected to a conical shape and attached to the lower skirt of the adaptor as described above. The user will then insert the end of the spray wand "W" through the opening 20 in the adaptor. The keyhole-shaped slot will provide flexibility to allow the insertion of the wand but provide sufficient frictional retention to maintain the adaptor on the wand.

FIG. 1 illustrates the wand secured to the guard in a ready-to-use position. The user may wish to trim the shield in accordance with the application. For example, when small plants, such as bedding plants that are close together, to be treated with a spray application, the lower edge may be trimmed to provide a shield of lesser diameter at the lower edge of the shield. The user will then place the shield over the plant to be treated. Since the shield is clear or transparent, this assists the user in visually positioning the plant within the conical shield 14. Spray may then be discharged within the enclosure within the guard which will prevent spray from being released into the air or onto adjacent soil and vegetation areas. Once the spray application has been terminated, the wand and shield may be lifted away from the plant and the operation repeated with respect to other plants.

In the event the user wishes to replace the shield 14, it can be detached at the adhesive strip on the fasteners 45 as the case may be. Replacement may be required in the event the shield is damaged, becomes weathered or, in the event that the user wishes replace the shield with another shield having other dimensions. Although in the preferred embodiment the shield is detachable from the adaptor, it may be desirable in some instances to use an adhesive or fastener which permanently affixes the two together.

It will be appreciated a preferred embodiment of the invention has been described herein. To the extent that various modifications may readily occur to those skilled in the art, it will be further appreciated that such modifications and variations may be made without departing from the spirit and scope and the invention.

What is claimed is:

1. A spray guard for use with the wand of a sprayer for spraying liquids, the wand having a tubular member with a nozzle at an outer end, said guard comprising:

(a) an adaptor having a body securable to said wand proximate said nozzle and having a depending flared skirt, said body having a slot extending in the body of the adaptor sized to allow insertion of the wand into the adaptor and allow removal of the wand from the adaptor via the slot;

(b) a spray shield being at least partially transparent and having a generally conical shape with a small open upper end and a larger open lower end, said shield being supported on said flared skirt at said open upper end of said shield; and (c) securement means for removably attaching said shield to said adaptor.

2. The spray guard of claim 1 wherein said shield is provided in a generally planar condition having a generally semi-circular shape and having fastener means for assembling the shield into said generally conical shape.

3. The spray guard of claim 1 wherein said shield is provided with trim lines to allow the user to trim the shield to a desired dimension.

4. The spray guard of claim 1 wherein said adaptor body is flexible.

5. The spray guard of claim 1 wherein said slot is keyhole-shaped.

6. The spray guard of claim 1 wherein said securement means comprises mechanical fastener means.

* * * * *